US006241148B1

(12) United States Patent
Schwimmer

(10) Patent No.: US 6,241,148 B1
(45) Date of Patent: Jun. 5, 2001

(54) POLYGON-SHAPED CONTAINER

(76) Inventor: Chaim Schwimmer, 5411 14th Ave., Brooklyn, NY (US) 11219

( * ) Notice: Subject to any disclaimer, the term of this patent is extended or adjusted under 35 U.S.C. 154(b) by 0 days.

(21) Appl. No.: 09/427,063

(22) Filed: Oct. 26, 1999

(51) Int. Cl.[7] ..... B65D 5/12

(52) U.S. Cl. ..... 229/122.21; 229/122.21; 229/198.3; 229/199; 229/109; 220/4.33; 206/600

(58) Field of Search ..... 229/122.21, 198.2, 229/198.3, 199, 108, 109, 122.32, 122.33; 206/600; 220/4.29, 4.33, 4.28, 4.21

(56) References Cited

U.S. PATENT DOCUMENTS

| | | | | |
|---|---|---|---|---|
| 641,207 | * | 6/1900 | Higham | 229/122.21 |
| 2,003,326 | * | 6/1935 | Wellman | 229/117.02 |
| 2,019,787 | * | 11/1935 | Leopold | 229/108.1 |
| 2,132,666 | * | 10/1938 | Williams | 229/125.05 X |
| 2,775,393 | * | 12/1956 | Rugg | 229/117.02 |
| 3,937,392 | * | 2/1976 | Swisher | 229/108 X |
| 4,635,815 | * | 1/1987 | Grigsby | 229/108 X |
| 4,673,087 | * | 6/1987 | Webb | 206/600 |
| 4,828,132 | * | 5/1989 | Francis, Jr. et al. | 220/6 |
| 5,377,857 | * | 1/1995 | Taravella et al. | 229/198.2 X |
| 5,690,274 | * | 11/1997 | Yang | 229/117 |
| 5,743,422 | * | 4/1998 | Hale | 229/198.3 X |

* cited by examiner

*Primary Examiner*—Allan N. Shoap
*Assistant Examiner*—Tri M. Mai
(74) *Attorney, Agent, or Firm*—Alfred C. Hill

(57) ABSTRACT

A polygon-shaped container comprising a plurality of normally rigid boards providing sides of a polygon-shaped container having a predetermined polygon configuration; a plurality of connecting members each connecting adjacent edges of the plurality of normally rigid boards together, each of the plurality of connecting members having sufficient strength to maintain the polygon-shaped container in the predetermined polygon configuration and yet sufficiently flexible to enable the plurality of normally rigid boards to be shipped flat to a user who will form the polygon-shaped container into the predetermined polygon configuration; a first arrangement to close a bottom of the polygon-shaped container; and a second arrangement to close a top of the polygon-shaped container after being filled.

8 Claims, 4 Drawing Sheets

POLYGON-SHAPED CONTAINER

BACKGROUND OF THE INVENTION

The present invention relates to containers and more particularly to polygon-shaped containers, such as Gaylord containers, made from normally rigid boards, such as Kraft linerboards laminated together up to approximately 400 thousands of an inch thick and having a capacity of up to 1,000 pounds or more.

Gaylord containers have been known and used for years to ship large quantities of material, 1,000 pounds or more. The Gaylord containers in the past have been made from corrugated paperboard, or cardboard. Corrugated cardboard containers are relatively weak and can be easily punched through by sharp objects.

If polygon-shaped containers, including Gaylord containers, could be made from normally rigid boards, such as several sheets of Kraft linerboard laminated together to a thickness of approximately 400 thousands of an inch, the containers would be such stronger and could not be punched through by sharp objects.

The problem with using the normally rigid boards, such as laminated Kraft linerboard mentioned above, is how do you bend such a board to make the polygon-shaped container without breaking the board at a bend.

SUMMARY OF THE INVENTION

An object of the present invention is to provide a plastic, flexible connecting member to connect a plurality of normally rigid board members together to form a desired polygon-shaped container and also to enable the polygon-shaped container to be shipped flat to a customer.

Another object of the present invention is to provide a container made from solid, normally rigid boards having a decigon configuration.

Another object of the present invention is to provide a container made from solid, normally rigid boards having a rectangular configuration.

A feature of the present invention is the provision of a polygon-shaped container comprising a plurality of normally rigid boards providing sides of a polygon-shaped container having a predetermined polygon configuration; a plurality of connecting members connecting adjacent edges of the plurality of normally rigid boards together, each of the plurality of connecting members having sufficient strength to maintain the polygon-shaped container in the predetermined polygon configuration and yet sufficient flexibility to enable the plurality of normally rigid boards to be shipped flat to a user who will form the polygon-shaped container into the predetermined polygon configuration; a first means to close a bottom of the polygon-shaped container; and a second means to close a top of the polygon-shaped container after being filled.

BRIEF DESCRIPTION OF THE DRAWING

Above-mentioned and other features and objects of the present invention will become more apparent by reference to the following description taken in conjunction with the accompanying drawing in which.

DESCRIPTION OF THE PREFERRED EMBODIMENTS

Figure 1:
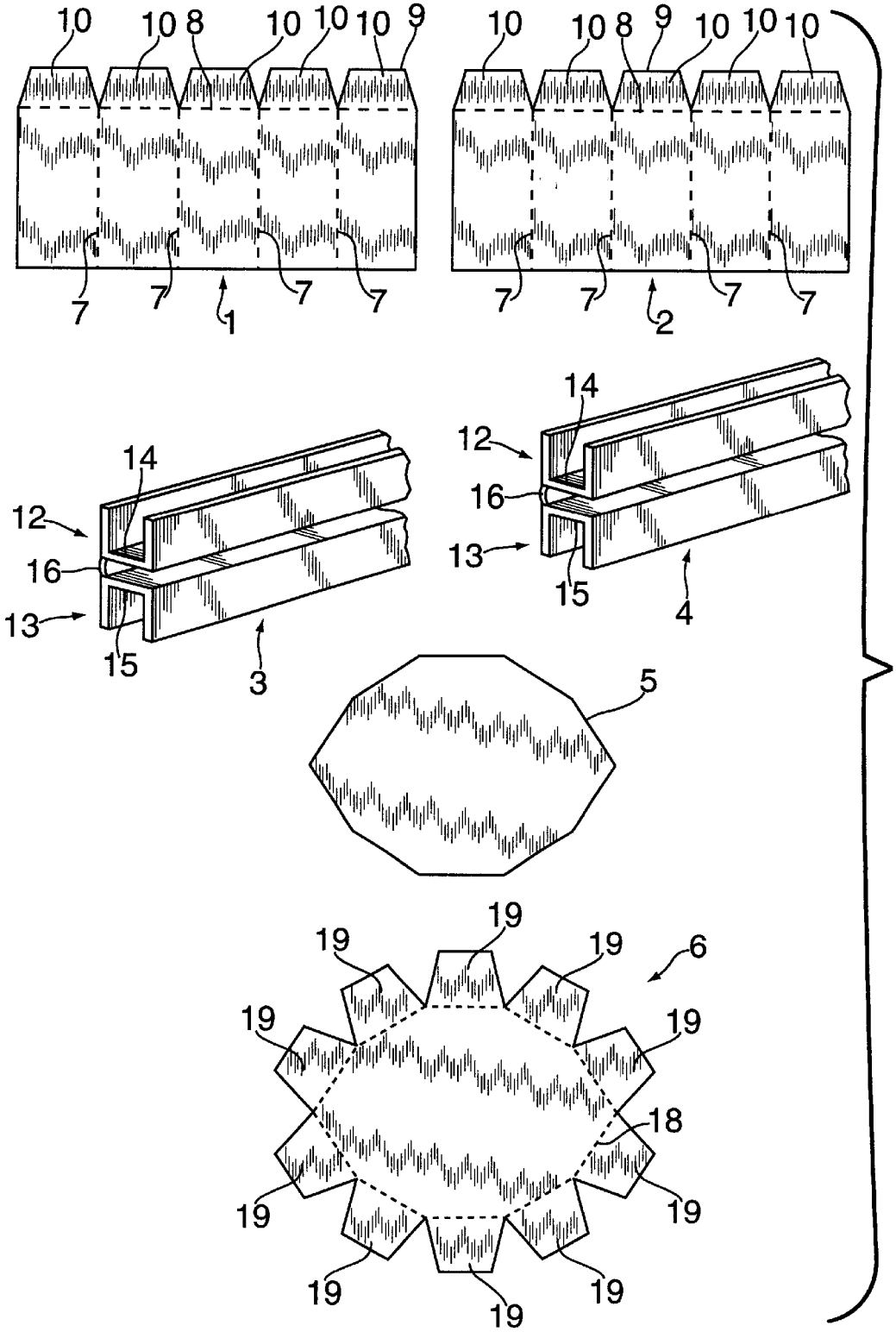
FIG. 1 illustrates the various parts of the polygon-shaped container having a decigon configuration in accordance with the principles of the present invention.

Referring to FIG. 1, there is illustrated therein the various components used to manufacture a polygon-shaped container having a plurality of sides and a plurality of angles. As illustrated in FIG. 1, the polygon-shaped container is a ten sided container, or a decigon container which is a container having ten sides and ten angles.

The decigon container is manufactured from a pair of normally rigid boards 1 and 2, such as Kraft linerboards, fiber boards or laminated fiber boards, a pair of connecting members 3 and 4 employed to join boards 1 and 2 into the decigon container, a first means, such as normally rigid bottom member 5 having a shape of the decigon container, to close a bottom of the decigon container and a second means, such as normally rigid cover member 6 also having the shape of the decigon container to close a top of the decigon container after the container is full.

Each of the boards 1 and 2 have a predetermined width and a predetermined length. Each of the boards 1 and 2, have a plurality of score lines 7 provided by a crease machine across the predetermined width to divide the predetermined length into five egual width sections, and a single score line 8 along the predetermined length parallel and a predetermined distance from edge 9. Each of the equal width sections are then cut between the edge 9 and the score line 8 to provide scalloped-like portions 10. Each of the boards 1 and 2 can now be bent on the plurality of score lines 7 to form one half of the decigon container.

Figure 2:
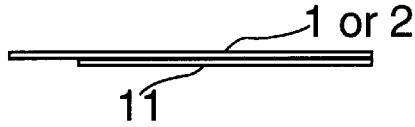
FIG. 2 is an end view of one of the board members of FIG. 1.

Ten sheets of a board that is relatively thin are each cut to fit between score lines 7 and score line 8 to provide laminae 11 as illustrated in FIG. 2. The laminae 11 do not interfere with the bending of the boards 1 and 2 into the one half of the decigon container, since the laminae 11 have a width less than the width of the equal width sections between lines 7.

Figure 3:
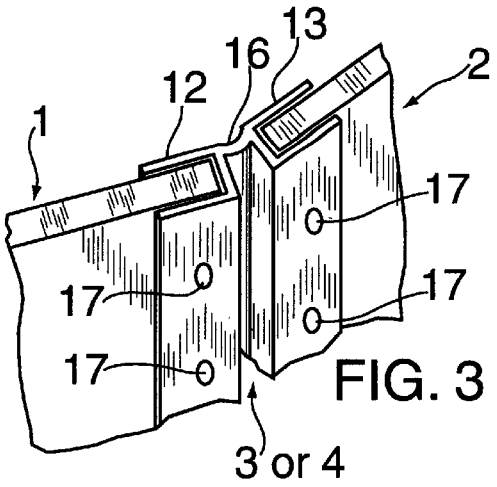
FIG. 3 is a perspective view illustrating the connection of one connecting member to the boards of FIG. 1.

Each of the connecting members 3 and 4 include a pair of integral, elongated U-shaped portions 12 and 13 with their cusp portions 14 and 15 adjacent each other. The U-shaped portions are interconnected by the web member 16 thereby providing flexibility for the connecting members 3 and 4. The U-shaped portions 12 and 13 engage and are secured to the associated edges of the pair of rigid boards between score line 8 and the edge of boards 1 and 2 remote from edge 9, as illustrated in more detail in FIG. 3. As illustrated in FIG. 3, the boards 1 and 2 are secured to the structural member 3 by means of rivets 17, or similar fasteners, such as staples.

The connecting members 3 and 4 can be manufactured from a plastic. The use of the plastic for connecting members 3 and 4 has two important features. The first feature is that it can join the panels to form the decigon container and the second feature is that the plastic is specially designed to be flexible at web member 16 so that the container can be folded flat for shipping purposes without weakening the container.

Figure 4:
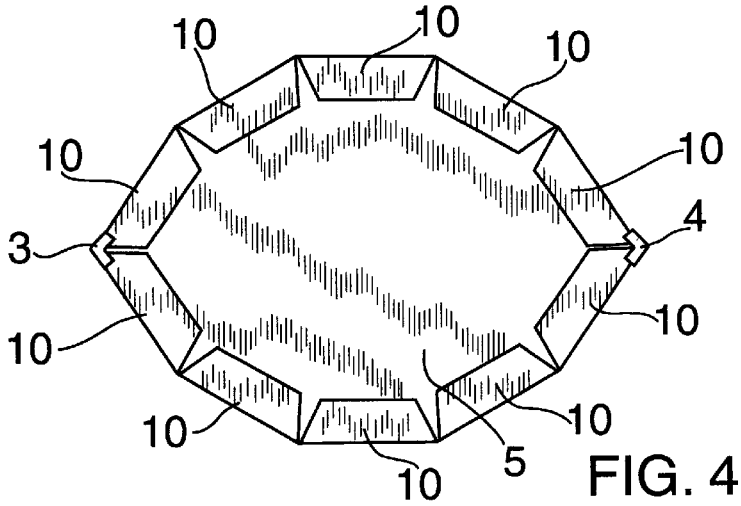
FIG. 4 is a view along line 4—4 of FIG. 5 illustrating how the bottom member of FIG. 1 is secured to the container of FIG. 5.

As an example, each of the boards 1 and 2 can be a laminated sheet having the size of 49" wide by 67.5" long, with the thickness of the board, which is made from a virgin linerboard, being 135–140 thousands of an inch thick which is passed through a creasing machine to provide the score lines 7. The score lines or creases are every 13.5". Then the boards 1 and 2 are passed through the creasing machine a second time to make the crease or score 8 along the length of the boards 1 and 2 7" from the edge 9. Each of boards 1 and 2 are then passed through a die cutting machine to cut the five equal width sections into a scalloped-like shape, such as shown at 10. Then ten sheets approximately 200 thousands of an inch thick are cut to a size 42" by 13" and then laminated to the ten equal width sections between score lines 7 of boards 1 and 2 and between score line 8 and an edge of boards 1 and 2 remote from edge 9 in a manner to enable boards 1 and 2 to bend inwardly. This provides a strong board 1 and 2, which is approximately 340 thousands of an inch thick and the boards 1 and 2 can still be bent into a half moon shape, When both boards 1 and 2 are bent into the half moon shape, or half of the shape of the decigon container, members 3 and 4 having a length of 42" are pushed onto adjacent ends of the boards 1 and 2 which are stapled or riveted or otherwise fastened from the top to the bottom so that the two boards 1 and 2 are attached to each other as one piece to provide a one piece decigon-shaped container which as mentioned hereinabove can then be shipped flat to a customer, When the flat decigon container is received by the customer, the customer stands it upside down, opens the box and puts into the box the normally rigid bottom member 5 which is die cut in a decigon shape so that it fits inside the container. The bottom member 5 does not fall down inside the container, since it is held on the edges of the panels which are laminated to the inside of boards 1 and 2. The bottom member 5 is then held in position by folding over the ten flaps 10, which are 7" in length, and secured to bottom member 5 by an adhesive, or other means. Note FIG. 4.

Figure 5:
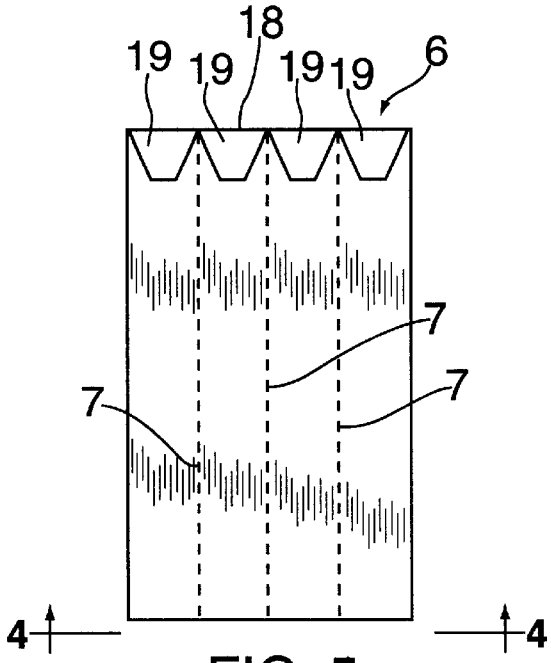
FIG. 5 is a plan view of how the cover member of FIG. 1 is secured to the decigon container.

The customer then would turn the container over and a normally rigid cover member 6 would be secured to the container. Cover member 6 is die cut to the same shape as the bottom, in other words, in a decigon configuration and will be 49" wide. Cover member 6 will be creased to provide score line 18 all around 4" from the edge. The material of cover member 6 between score line 18 and the edge of cover member 6 will be die cut into flaps 19 so that they can be folded all around onto the side of the container and glued thereto to form the complete container having a decigon configuration. Note FIG. 5.

Figure 6:
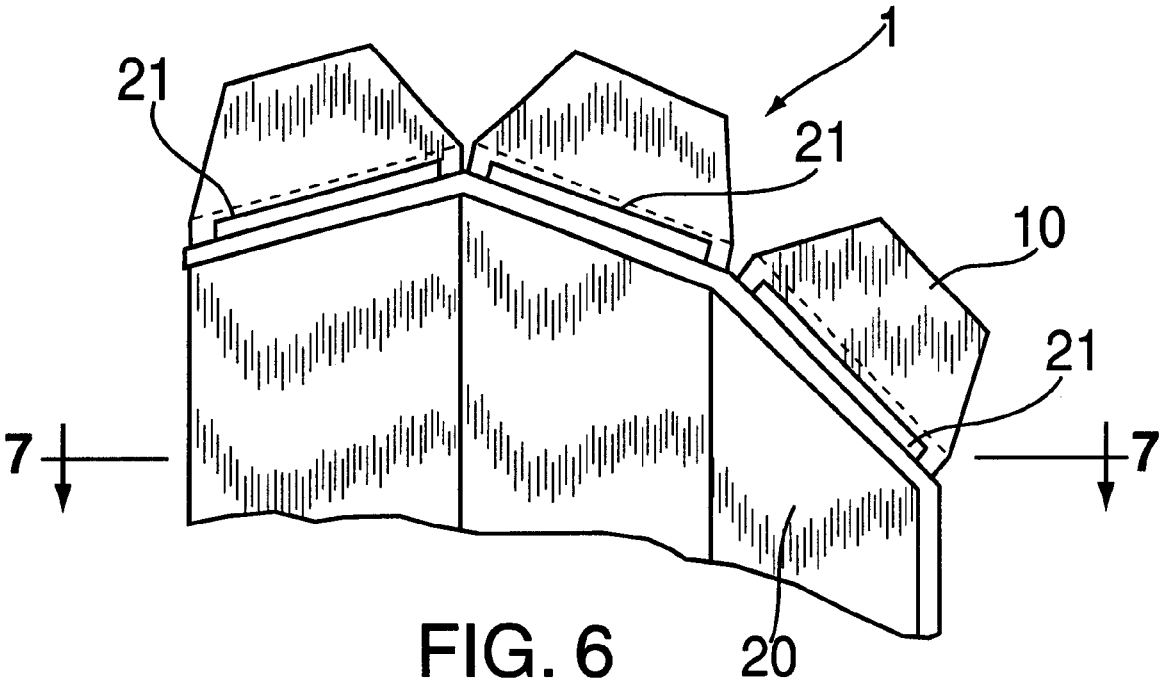
FIG. 6 is a partial perspective view illustrating a second embodiment of the decigon container in accordance with the principles of the present invention.

There are certain situations where a decigon-shaped container may require greater rigidity and strength. This can be accomplished employing the principles of the present invention in the manner illustrated in FIGS. 6 and 7.

Within boards 1 and 2 there is disposed an additional pair of boards 20 each being similar to, but slightly smaller than boards 1 and 2. The additional pair of boards 20 are scored similar to the plurality of score lines 7 of boards 1 and 2 and are positioned within, but spaced from boards 1 and 2. The boards 20 have a width to enable them to be located between score line 8 and the edge of boards 1 and 2 remote from edge 9.

Figure 7:
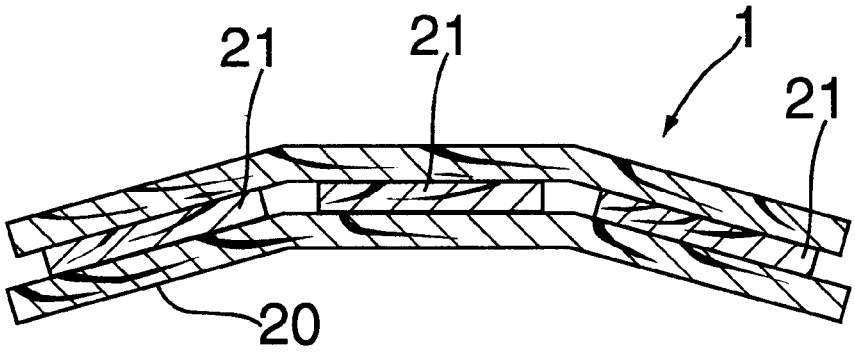
FIG. 7 is a cross-sectional view of the second embodiment of FIG. 6 taken along line 7—7 thereof.

There is also provided a spacer member 21 between boards 1 and 2 and boards 20. The boards 1 and 2, boards 20 and spacer member 21 are laminated together, but yet can be bent to form the decigon container as described above. To enable bending boards 1,2 and 20, the spacer members 21 have a width less than the width of the equal width sections of boards 1, 2 and 20 as illustrated in FIG. 7.

The decigon container disclosed herein can be employed for packaging solid material. By employing an impervious liner disposed within the decigon container, a liquid can be packaged therein.

Figure 8:
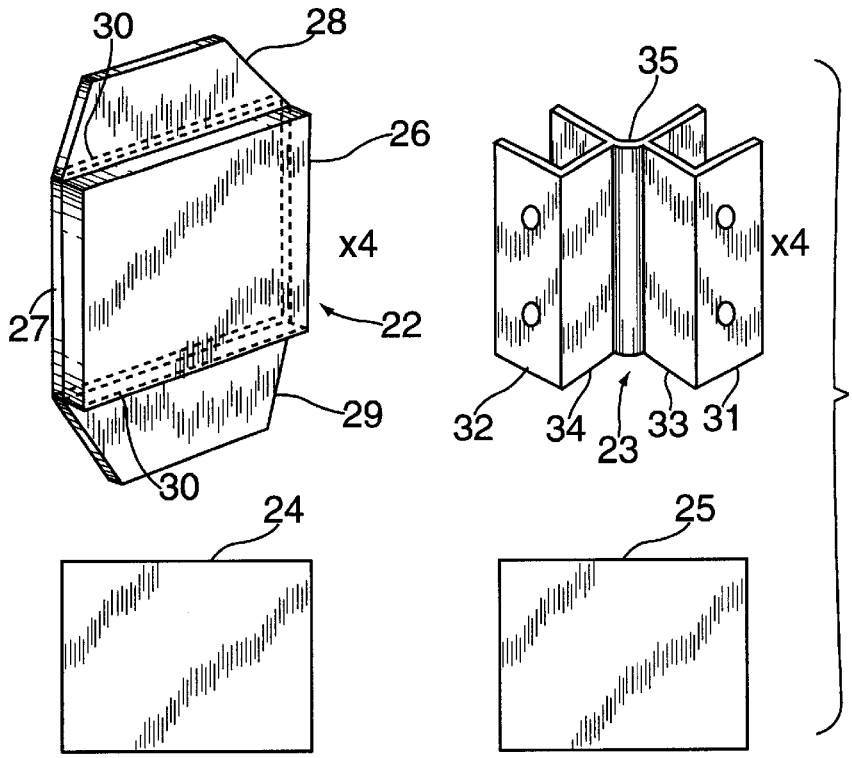
FIG. 8 illustrates the various parts of the polygon-shaped container having a rectangular configuration in accordance With the principles of the present invention.

Referring to FIG. 8, there is disclosed therein the various components used to manufacture a polygon-shaped container having four sides and four angles, namely, a rectangular container having unequal length adjacent sides, or a rectangular container having equal length adjacent sides, more commonly called a square.

The rectangular container is manufactured from four normally rigid boards 22, four connecting members 23 employed to join boards 22 into a rectangular container, a first means, such as normally rigid bottom member 24 have a shape of the rectangular container, to close the bottom of the rectangular container and a second means, such as normally rigid cover member 25 also having the shape of the rectangular container to close the top of the rectangular container when the container is full.

Each of the four normally rigid boards 22 includes a relatively thick normally rigid board 26 (400 thousands of an inch thick) having a predetermined length and a predetermined width and a relatively thin normally rigid board 27 (130 thousands of an inch thick) laminated to an outer surface of board 26. Board 27 has a length equal to the predetermined length of board 26 and a width greater than the predetermined width of board 26. Board 27 extends beyond the width of board 26 on both sides thereof to form flaps 28 and 29. A score line 30 is provided in each of flaps 28 and 29.

The four connecting members 23 each include a pair of integral, elongated U-shaped portions 31 and 32 with their cusp portions 33 and 34 adjacent each other. The portions 31 and 32 are interconnected by web member 35 to provide the flexibility necessary for the rectangular container to be shipped flat to a user as is the case of connecting members 3 and 4 of the decigon container. As with connecting members 3 and 4, connecting members 23 are manufactured from a specially designed plastic to enable joining the four members 22 to form the rectangular container and to be flexible at web member 35 so that the rectangular container can be folded completely flat for shipping purposes without weakening the rectangular container.

Figure 9:
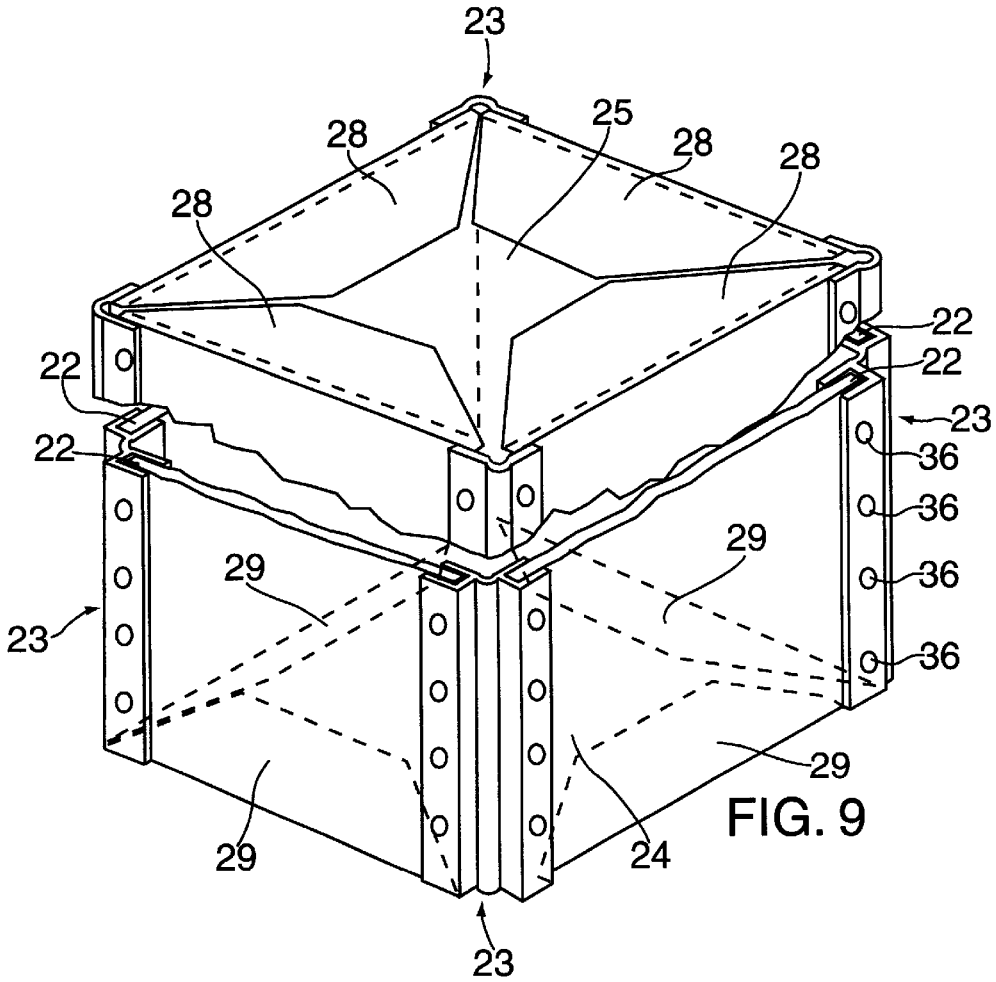
FIG. 9 is a perspective view of a rectangular container in accordance with the principles of the present invention.

Referring to FIG. 9, there is illustrated therein a perspective view of completed rectangular container. The four connecting members 23 join the four boards 22 to form the sides of a rectangular container. Members 23 are fastened to boards 22 by means of rivets 36, or some other fastener such as a staple. Once the sides of the container are formed the normally rigid bottom member 24 can be put in place and held there by flaps 29 formed on board 27. Flaps 29 are secured to bottom member 25 by an adhesive, or similar securing means. Once the container is filled the normally rigid cover member 25 can be placed in position to close the container and held in place by flaps 28 formed on board 27. Flaps 29 are secured to cover member 24 by an adhesive, or similar securing means. Flaps 28 and 29 are bent along score line 30 to engage the cover member 25 and the bottom member 24, respectively.

It should be recognized that the four boards 22 can be provided without board 27. In that situation the bottom member 24 and cover member 25 can be held in place by means other than flaps 29 and 28, such as metal bands, or the like.

It also should be recognized that the four boards 22 can be provided with boards 26 and 27, but with only one of flaps 28 and 29. If flap 25 is provided, cover member 25 would be held in place by flap 28 secured thereto. In this situation, bottom member 24 would be held in place by means other than flap 29, such as a metal band, or the like. If flap 29 is provided, bottom member 25 would be held in place by flap 29 and cover member 25 be held in place by other means, such as a metal band, or the like.

The rectangular container disclosed herein can be employed to package both solid and liquid material with an impervious liner being disposed in the rectangular container when desiring to ship a liquid therein. However, due to the inertia or sloshing of the liquid in a rectangular container which would tend to move the container around during transport, the packaging of a liquid is more advantageouly accomplished in a drum, or a decigon container as disclosed herein, which has reduced liquid inertia relative to a rectangular container.

The impervious liner for both the decigon and rectangular containers is a poly coated paper liner with the poly layer adjacent the liquid, or on the inside of the paper layer. When placed in either the decigon or rectangular container, the inside of the container is sprayed or otherwise coated with an adhesive to which the paper layer of the poly coated paper liner will adhere to keep the liner in place during transport thereby preventing wear on the liner and to prevent interferring with the emptying of the liquid.

The use of just a poly liner has disadvantages that are detrimental to the transport and emptying of a liquid. There are no adhesives that can be used to hold a poly liner in place in the container without causing deterioration of the poly material thereby causing leaks in the liner and the container. Due to corners in the container, the poly liner will experience wear during transport which again results in leaks in the liner and the container. Since the poly liner is not held in place, the liner will collapse during emptying of the liquid which hinders emptying of the liquid.

The bottom member 24 and cover member 25 can be eliminated when boards 22 are made with flaps similar to flaps 28 and 29 having proper dimensions to provide the first and second means to close both ends of the rectangular container.

It should also be noted that bottom member 5 and cover member 6 of FIG. 1 can be eliminated by providing flaps on members 1 and 2 dimensioned to provide the first and second means to close both ends of the decigon container.

Both the decigon container and the rectangular container can be made from thick, light weight material, or by increasing the number of sheets laminated together to enable shipping very heavy material.

While I have described above the principles of my invention in connection with specific apparatus, it is to be clearly understood that this description is made only by way of example and not as a limitation to the scope of my invention as set forth in the objects thereof and in the accompanying claims.

I claim:

1. A polygon-shaped container comprising:

a plurality of normally rigid boards providing sides of a polygon-shaped container having a predetermined polygon configuration;

a plurality of connecting members, each of said plurality of connecting members connecting adjacent edges of said plurality of normally rigid boards together, each of said plurality of connecting members having sufficient strenght to maintain said polygon-shaped container in said predetermined polygon configuration and yet sufficient flexibility to enable said plurality of normally rigid boards to be shipped flat to a user who will form said polygon-shaped container into said predetermined polygon configuration;

a first means to close a bottom of said polygon-shaped container;

a second means to a top of said polygon-shaped container after being filled;

each of said plurality of connecting members including a pair of integral, elongated U-shaped plastic members having their cusp portions adjacent each other, and an elongated web member interconnecting said cusp portion to provide an integral unit, each of pair of elongated U-shaped plastic members engaging and secured to associated adjacent edges of said plurality of normally rigid boards, said predetermined polygon configuration is being a decigon configuration to provide a decigon container;

said plurality of normally rigid boards equal two normally rigid boards having a predetermined width and a predetermined length;

each of said two normally rigid boards including four score lines across said pr determined width to divide said predetermined length into five equal width sections, a single score line along said predetermined length parallel to one edge thereof a pr determined distance from said one edge, each of said five equal width sections having a scalloped-like portion disposed between said one edge and said single score line, each of said two normally rigid boards being bent on said plurality of score lines to form one half of said decigon container; and two of said pair of integral, elongated U shaped plastic members engage and are secured to associated adjacent edges of said two normally rigid boards to provide said decigon container.

2. A container according to claim 1, wherein said first means includes a normally rigid bottom member having a decigon configuration disposed within said decigon container adjacent said single score line of each of said two normally rigid boards, said normally rigid bottom member being secured in position by each of said scalloped-like portions when bent along said single score line of each of said two normally rigid boards each of said scalloped-like portions being fastened to said normally rigid bottom member.

3. A container according to claim 2, wherein each of said two normally rigid boards includes a laminae disposed at least between said single score line and the other edge remote from said one edge.

4. A container according to claim 2, wherein said second means includes a normally rigid cover member having a decigon configuration and ten scalloped-like parts disposed around the periphery thereof, said ten scalloped-like parts being bent over along a peripheral score line and secured to sides of each of said five equal width sections of each of said two normally rigid boards.

5. A container according to claim 4, wherein each of said two normally rigid boards includes a laminae disposed at least between said single score line and the other edge remote from said one edge.

6. A container according to claim 1, wherein said second means includes a normally rigid cover member having a decigon configuration and ten scalloped-like parts disposed around the periphery thereof, said ten scalloped-like parts being bent over along a peripheral score line and secured to sides of each of said five equal width sections of each of said two normally rigid boards.

7. A container according to claim 6, wherein each of said two normally rigid boards includes a laminae disposed at least between said single score line and the other edge remote from said one edge.

8. A container according to claim 1, further including an additional pair of normally rigid boards disposed within said two normally rigid boards in a spaced relationship, said additional pair of normally rigid boards having a width substantially equal to the width of said two normally rigid boards and scored across its width to enable bending in consort with said two normally rigid boards to form said decigon container; and a spacer member disposed between each of said five equal width sections of each of said two normally rigid boards and said additional pair of normally rigid boards having a width less than the width of said five equal width section of each of said two normally rigid boards to enable bending said two normally rigid boards and said additional pair of normally rigid boards to form said decigon container.

* * * * *